United States Patent [19]

Eisinger

[11] Patent Number: 4,606,209

[45] Date of Patent: Aug. 19, 1986

[54] DISC ROLLER MECHANISM FOR FORMING HELICAL SHAPES

[75] Inventor: Frantisek L. Eisinger, Demarest, N.J.

[73] Assignee: Foster Wheeler Energy Corporation, Livingston, N.J.

[21] Appl. No.: 710,652

[22] Filed: Mar. 11, 1985

Related U.S. Application Data

[63] Continuation-in-part of Ser. No. 701,440, Feb. 12, 1985, Pat. No. 4,546,631, which is a continuation of Ser. No. 481,135, Apr. 1, 1983, abandoned.

[51] Int. Cl.[4] ..... B21E 3/02

[52] U.S. Cl. ..... 72/135; 72/145

[58] Field of Search ..... 72/64, 65, 66, 95, 98, 72/100, 135, 137, 145, 160, 161, 164, 298, 371; 140/147, 149

[56] References Cited

U.S. PATENT DOCUMENTS

| | | | |
|---|---|---|---|
| 2,749,962 | 6/1956 | Kitselman | 72/145 |
| 2,769,478 | 11/1956 | Schane | 72/145 |
| 4,278,743 | 9/1981 | Hantschk | 72/145 X |
| 4,412,565 | 11/1983 | Broberg | 72/160 X |

FOREIGN PATENT DOCUMENTS

| | | | |
|---|---|---|---|
| 1176968 | 8/1964 | Fed. Rep. of Germany | 72/160 |
| 1235847 | 3/1967 | Fed. Rep. of Germany | 72/164 |
| 1014885 | 8/1952 | France | 72/135 |
| 688807 | 3/1953 | United Kingdom | 72/160 |

*Primary Examiner*—E. Michael Combs

*Attorney, Agent, or Firm*—Marvin A. Naigur; John E. Wilson; Martin Smolowitz

[57] ABSTRACT

A disc roller mechanism and method for forming helical-shaped structures from a feed wire or rod, wherein the feed wire is drawn through a plurality of staggered disc-shaped forming rollers by rotation of the rollers, while the wire is also being rotated about its own axis so as to form the desired helical-shaped product. The roller mechanism includes a support frame and a first set of at least two fixed position driven disc-shaped rollers and a second set of at least one idler disc-shaped rollers, said idler rollers being transversely adjustable positions relative to the first driven roller set rotatably mounted in the frame. The driven roller set usually has a roughened outer perimeter surface to facilitate drawing the feed wire through the intersecting forming rollers. If desired, the feed wire can be pulled off a rotatable supply spool such as by a pair of guiding rollers and then passed through the staggered disc-shaped forming rollers to provide the desired helical-shaped product.

14 Claims, 3 Drawing Figures

DISC ROLLER MECHANISM FOR FORMING HELICAL SHAPES

This is a continuation-in-part of application Ser. No. 701,440, filed Feb. 12, 1985, U.S. Pat. No. 4,546,631, which is a continuation of Ser. No. 481,135 filed Apr. 1, 1983, and now abandoned.

BACKGROUND OF INVENTION

This invention pertains to a disc roller mechanism and method used for forming helical shapes from a resilient wire or bar stock material using multiple rotatable disc-shaped forming rollers. It pertains particularly to such a disc roller forming mechanism and method in which the feed wire is continuously drawn through the multiple forming rollers while the wire is being simultaneously rotated about its own longitudinal axis, so as to form helical shapes having various desired parameters of diameter and pitch.

Mechanisms for forming of helical shapes have been previously developed, as disclosed by U.S. Pat. No. 2,749,962 to Kitselman and U.S. Pat. No. 2,769,479 to Schane. However, in both these wire forming mechanisms the wire being formed is pushed by a feeding means through rotating forming rollers, which can result in large compressive stresses being developed in the wire and can cause undesired deformation and buckling of the wire, particularly for small diameter wires which are relatively flexible and prone to bending. Such wire instability problems when forming helical shapes are substantially eliminated by the present invention, which advantageously draws the wire through the multiple forming rollers and utilizes small tensile forces developed in the wire being formed to provide a superior helical-shaped structural product.

SUMMARY OF INVENTION

The present invention provides a disc-shaped roller forming mechanism and method for continuously forming elongated helical shapes or structures from a wire or bar stock material, which material preferably has a circular cross-sectional shape. More specifically, the disc roller forming mechanism of the invention comprises a support frame for supporting two sets of multiple parallel disc-shaped rollers, usually consisting of a first set of driven rollers and a second set of idler rollers, although both sets of rollers can be driven if desired. The first or driven roller set is rotatably mounted in a fixed member of the support frame, and the second roller set is rotatably mounted in an adjustable member of the frame. The two forming roller sets are usually mounted with the driven rollers as the lower set and the idler rollers as the upper set; however, the two roller sets can alternatively be mounted in a substantially horizontally oriented parallel arrangement if desired.

The disc rollers in each set are rigidly mounted on a rigid rotatable shaft, such as by a key and keyway arrangement, and the rollers in each set are equally spaced apart from each other by spacers on the shafts. The first set of rollers is rotatably driven by an input shaft, while the second roller set usually rotates freely with its shaft, both sets of rollers being rotatably mounted in the frame structure so as to be substantially parallel with each other. The roller sets are rotatably mounted in the frame structure in an alternating or staggered pattern, so that the roller periphery surfaces approach each other and may intersect by a limited and controlled extent for forming the desired helical-shaped structures.

A straight resilient wire or rod, which is to be formed into a helical shape, is guided and introduced in between the first driven roller set and the second usually idler roller set, for which the roller diameters of each set are arranged to approach and sometimes may intersect each other. Thus, the second set of rollers is forced laterally against the wire being formed, so that by rotating the driven rollers the wire will rotated due to its frictional contact with the driven rollers, and the idler rollers will rotate due to their frictional contact against the wire, and thereby bend and form the wire into a desired helical-shaped structure. Due to the rotating action of the wire being formed by the two roller sets, a force component is provided in the wire in the axial direction, which force draws the wire through the forming rollers while the wire is simultaneously rotated about its own axis to provide a helical-shaped structural product. The driven rollers preferably each have a knurled or roughened outer surface to increase their frictional contact with the wire being formed.

Because the second or idler roller set is rotatably mounted in adjustable frame members, it is transversely adjustable relative to the first fixed position driven roller set in the direction perpendicular to the shaft axes. The pitch p of the helical shape being formed is determined by the spacing between adjacent rollers in each set, with radius r of the outer tire of each roller disc usually being 0.3–0.5 times the spacing between the rollers. For forming helical shaped structures having a different geometry, different roller sets are used having different radii r, with the spacers located between the adjacent rollers determining the helix pitch p for the helical shape being formed.

The first driven roller set contains at least two disc-shaped forming rollers and the second or idler roller set contains at least one disc-shaped roller. There is usually no need for each roller set to contain more than five rollers, with the first roller set preferably containing three rollers and the second roller set containing two rollers. The driven roller set is usually rotated at 20–100 rpm depending upon the means used for supplying the feed wire. The two roller sets have equal surface speeds and usually have equal diameters; however, they can have unequal diameters, if desired. If both roller sets are rotatably driven such as from the normally driven shaft by suitable drive means such as drive gears and a chain, the drive means used must provide equal surface speeds for the forming rollers and also permit adequate lateral adjustment between the parallel roller sets.

To start the wire forming process, a die having a helix shape is welded or otherwise rigidly attached to the leading end of a relatively straight feed wire which is to be helically formed. This die, which is a preformed helical structure, will cause the straight feed wire to move forward into the forming rolls and to simultaneously rotate about its own axis, thus starting the forming process for the feed wire. The straight feed wire being helically formed is rotated due to its frictional contact with the driven and idler rollers. When the feed wire is a straight piece, no restrictions to its rotation are imposed. However, if the feed wire being formed is a long wire being unwound from a spool, the entire spool and its mounting unit are arranged to rotate about the longitudinal axis of the wire being formed synchronously with the wire rotation imposed during the forming process.

The disc roller forming mechanism and method of this invention can be used for forming metal wires, rods, or tubes having outside diameters in a range of about 0.100–0.500 inches into helical-shaped structures which usually have an outside diameter of 1–3 inches, although larger size helixes having larger diameter wires can be similarly produced. The helical pitch of the structures formed will be equal to the adjacent disc roller spacing in each set of rollers, and will usually be in a range of about 0.75 to 3 inches.

Advantages of the present disc roller mechanism design arrangement and method for forming helical-shaped structures are primarily that the mechanism is simple and compact, as only two rotating disc roller sets are required for producing desired helical-shaped structures. Also, the forming mechanism, i.e., rollers and their supporting shafts, can be easily designed to have sufficient strength and stiffness to withstand the forces imposed upon them by the wire being helically formed by drawing the wire through the rotating roller sets.

DESCRIPTION OF INVENTION

Figure 1:
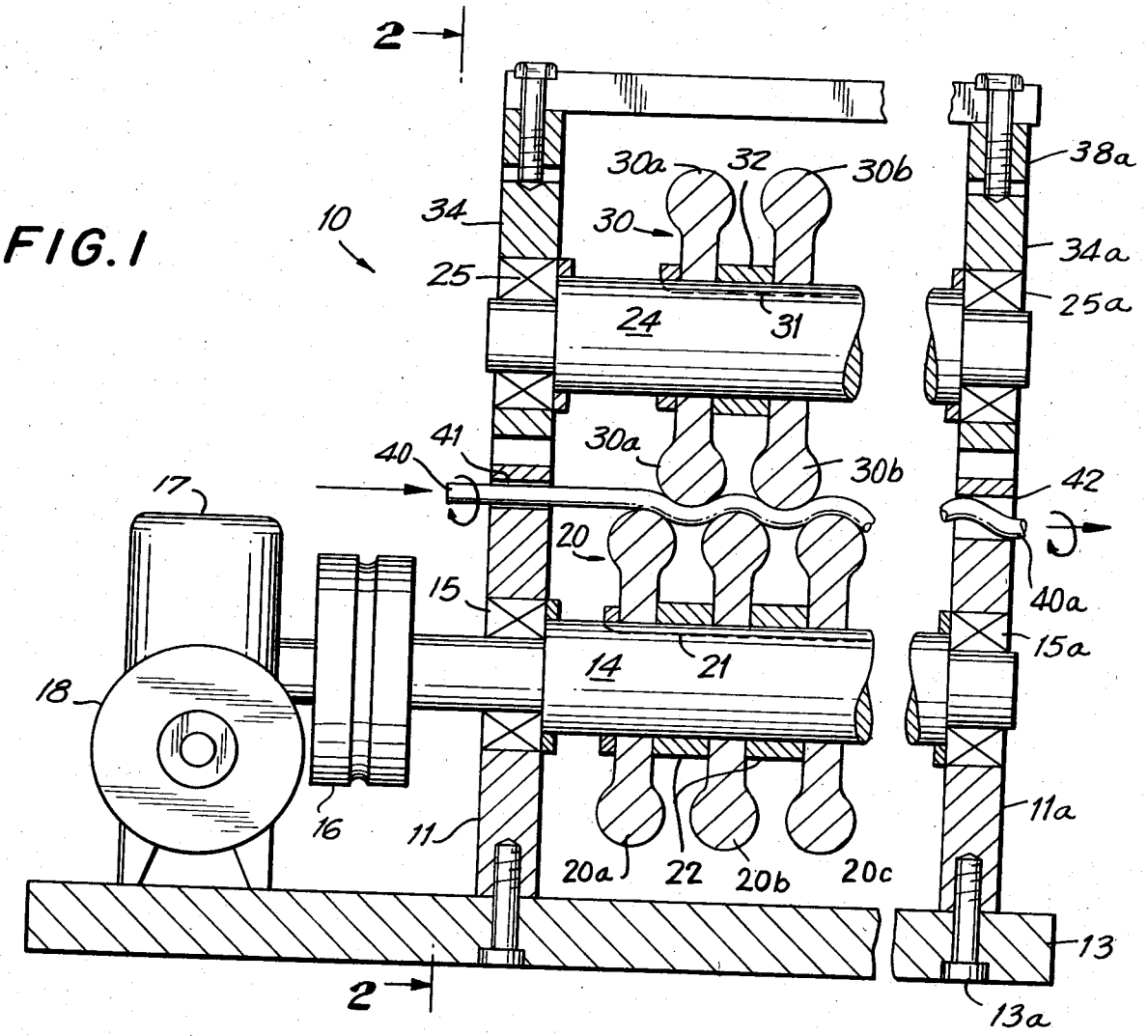
FIG. 1 shows a sectional elevation view of the disc roller mechanism for forming helical shapes according to the present invention.

The disc roller mechanism and method of the present invention will be described in greater detail by reference first to FIG. 1. The disc roller mechanism 10 includes a frame 12 made up of two substantially parallel plates 11 and **11*a*, which are spaced apart and rigidly attached to frame base 13 by suitable means such as bolts 13*a*. Extending through the frame 12 is a driven lower shaft 14, which is rotatably supported at each end by bearings 15 and 15*a* located in plates 11 and 11*a*, respectively. Shaft 14 is rotatably driven through coupling 16 and gear reducer 17 by motor 18**.

Disc roller set 20 is rigidly attached to shaft 14 by key 21, and the disc-shaped rollers **20*a*, 20*b*, 20*c*, etc., are equally spaced apart from each other by spacers 22. Upper shaft 24 is also similarly rotatably supported in frame 12 by bearings 25 and 25*a*, respectively, and contains disc roller set 30, which discs are keyed to the shaft by key 31. The disc-shaped rollers 30*a* and 30*b* are spaced apart by spacer 32. As shown, the two upper rollers 30*a* and 30*b* are arranged in a staggered relation with the three rollers 20*a*, 20*b*, and 20*c* of lower disc set 20. The roller sets 20 and 30 are substantially parallel with each other, and the transverse spacing between them in a direction perpendicular to their axis is made adjustable by the roller set 30 being rotatably mounted in adjustable frame members 34 and 34*a***.

A feed wire 40 to be formed into a helical shape is inserted first through a guide opening 41 located in the frame plate 11, and is then fed between the adjacent staggered forming rollers of the roller disc sets 20 and 30. The wire 40 is rotated about its own axis and bent by friction from the staggered rotating discs 20 and 30, so as to form a helical shaped structure **40*a*, which emerges through opening 42 in plate 11*a* at the opposite side of frame 12**.

Figure 2:
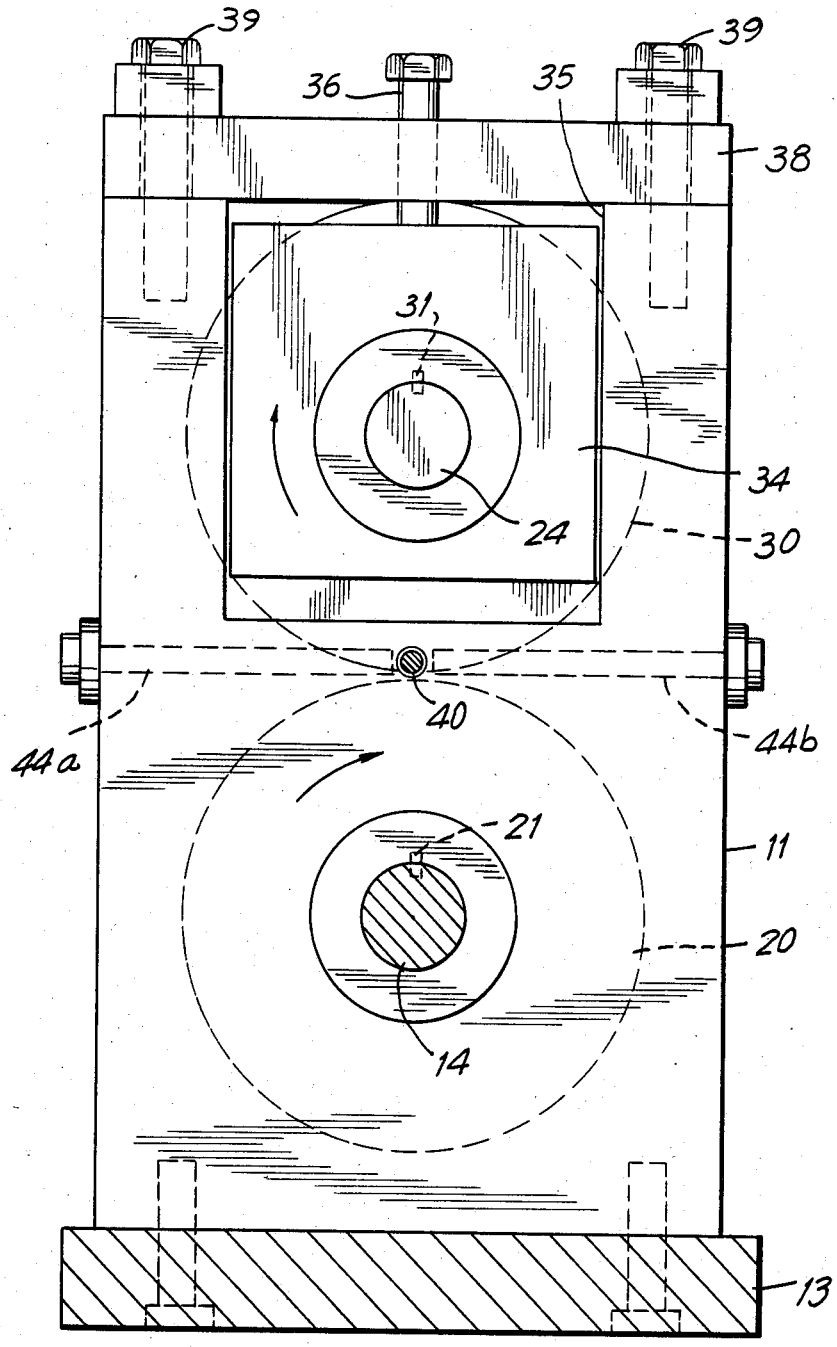
FIG. 2 shows an end view of the disc roller mechanism taken at section 2—2′ of FIG. 1.

An end view of the roller mechanism 10 is provided by FIG. 2, which shows the relative orientation of the lower roller set 20 and the upper roller set 30 in relation to the feed wire 40. As shown in FIG. 2, upper roller shaft 24 and the disc set 30 carried thereon are rotatably supported at each end in adjustable block members 34 and **34*a*. These blocks are each adjustably mounted in central slotted openings 35 and 35*a* in the dual frame plate members 11 and 11*a*, by adjusting screws 36 and 36*a* threaded through upper frame members 38 and 38*a*, which is rigidly attached to end plates 11 and 11*a* by bolts 39. As is shown, the feed wire 40 being formed is maintained in a desired central position relative to the dual forming roller sets 20 and 30 by lateral guides 44*a* and 44*b*, which are adjustably attached to the frame member 11 and extend inwardly to terminate near the feed wire 40. The spacing between the parallel roller sets 20 and 30 and the extent of any intersection between the two roller sets determines the outside diameter of the helical-shaped structure 40*a*** being formed.

In the method of the present invention, the feed wire 40 is first guided and inserted through opening 41 in the inlet side plate 11 and then is engaged by the near intersecting forming roller sets 20 and 30. The rotation of the adjacent roller outer surfaces in opposite directions relative to the feed wire 40 causes the wire to be rotated about its own axis while it is being helically formed by the successive rollers **20*a*, 30*a*, 20*b*, 30*b*, etc., and thereby provides a component force in the axial direction of the wire. This component force draws the feed wire through the forming roller sets while rotating the wire about its own axis to form a helical-shaped structural product 40*a***.

Figure 3:
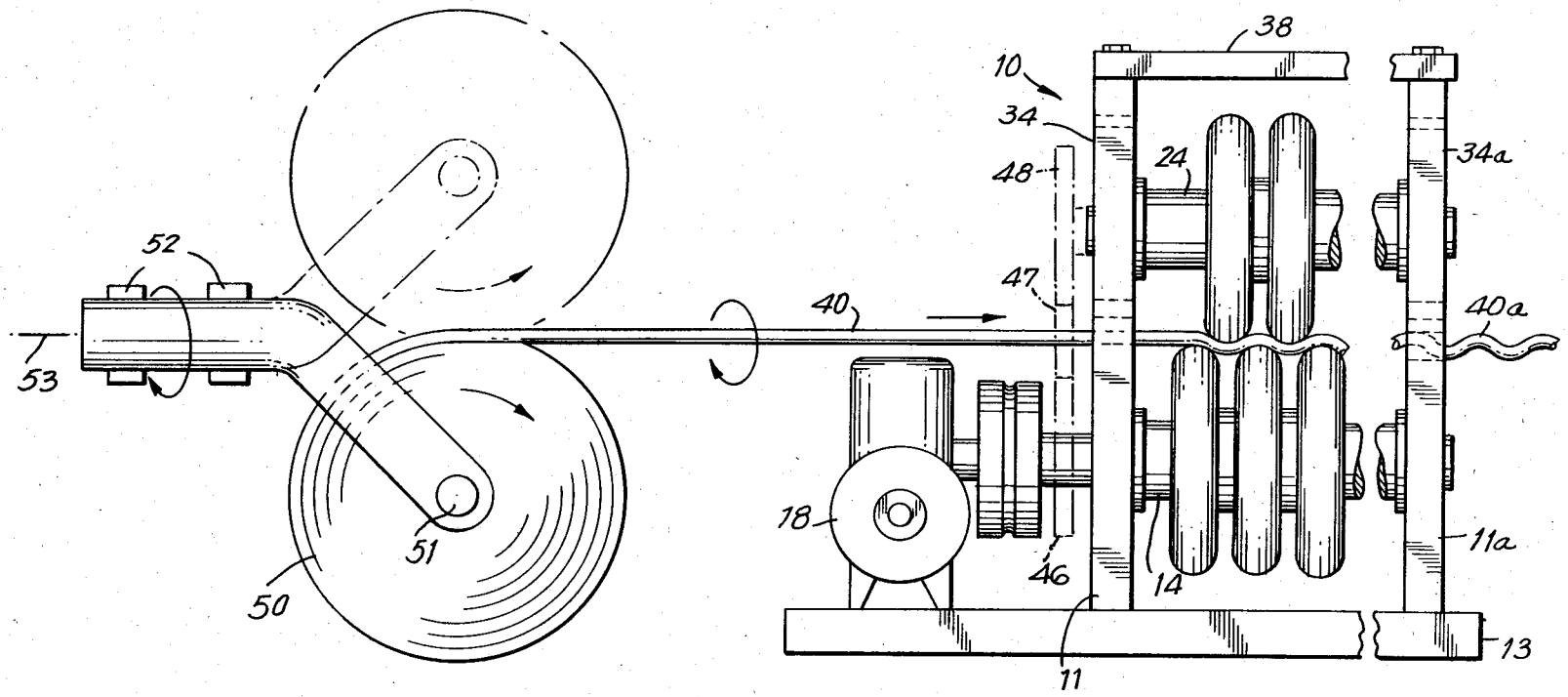
FIG. 3 is a schematic view of the invention showing the disc roller mechanism means for withdrawing the feed wire from a supply spool and for rotating the feed wire about its own axis during forming of helical shaped structures.

If it is desired to rotatably drive the upper roller set 30, this can be conveniently accomplished by means as shown in FIG. 3. A gear 46 is provided rigidly attached on lower shaft 14, and a gear 48 is provided rigidly attached on upper shaft 24, and the two gears are connected by an encircling drive chain 47, which also encircles the feed wire 40. The pitch diameters of gears 46 and 48 are so selected in relation to the diameters of the rollers 20 and 30 that the rollers all have equal surface speeds.

The feed wire or rod 40 can be provided as long relatively straight pieces before forming. When such a straight wire is fed into the forming mechanism, only guide means 41 and 44 are needed for supporting the straight wire, because its rotation about its own axis is provided by action of the forming rollers themselves. A helical die which serves as a leader for pulling the straight wire or bar through the forming rollers is used and is usually welded to the feed end of the wire 40 before forming. A cut-off means (not shown) for the helical shaped product can be provided after frame member **11*a***, and can be made a part of the wire forming mechanism.

When it is desired to continuously form long helical-shaped structural products, the feed wire 40 can be preferably provided from a rotatable reel or spool 50, as is functionally shown in FIG. 3. The supply spool 50 is retained in a holding device 52 and is rotated about the spool center axis 51, while the spool 50 is also being rotated about axis 53 of the spool holding device 52, which is positioned substantially parallel to the longitudinal axis of the feed wire 40 as it is fed into the forming rollers. The rotation of wire spool 50 and holding device 52 about mounting axis 53 is produced in a conventional manner by a drive motor and variable speed gear reducer (not shown) connected to the spool support device 52. Although FIG. 3 shows the correct functional relationships between spool 50 and holder 52, if it is desired to use a larger diameter supply spool so as to contain a larger quantity of feed wire, spool 50 could alternatively be supported by bearings of the holder device 52 being located on opposite sides of spool 50 and arranged so that axis 53 passes more nearly through the center of the spool 50. The rate of rotation of the wire spool 50 about longitudinal axis 53 must be related to the rate or rotation of the forming rollers, so as to produce the desired helical-shaped structure.

This invention will be further described in terms of the following example, which should not be construed as limiting the scope of the invention.

EXAMPLE

A steel wire having diameter of 0.125 inch is fed into a disc roller forming mechanism having two upper idler rollers and three lower rollers driven from a rotating drive shaft. The two roller sets are arranged in a staggered pattern and are rotatably supported at each end in a frame having parallel side members. The driven lower rollers each have knurled outer surfaces so as to increase friction between the rollers and the wire being formed. The feed wire is rotated about its own axis while being passed through the rotating disc roller mechanism, which results in a helical-shaped structure being formed having an outside diameter of about 1.5 inches emerging from the roller forming mechanism.

Although this invention has been disclosed broadly and in terms of a preferred embodiment, it is understood that other variations and modifications can be made to the roller mechanism and method of use within the spirit and scope of the invention, which is defined by the following claims.

I claim:

1. A disc roller mechanism for forming elongated helical-shaped structures using multiple disc-shaped forming rollers, comprising:

(a) a support frame having a fixed member and an adjustable member, each said member being adapted for rotatably supporting a shaft each carrying multiple parallel disc-shaped rollers;

(b) a first set of disc-shaped forming rollers including at least two disc-shaped rollers spaced apart from each other and rotatably mounted in said support frame fixed member, said first set of rollers being rotatably driven;

(c) a second set of disc-shaped forming rollers including at least one disc-shaped roller rotatably mounted in said support frame adjustable member, and arranged in a staggered pattern relative to the rollers of said first set of rollers, said second disc-shaped roller set being substantially parallel with and transversely adjustable relative to the first set, the axes of said forming rollers in said first and second sets being oriented parallel to the centerline of a feed wire for drawing said wire through said first and second sets of disc-shaped forming rollers solely by a frictional drawing force exerted on the wire by said sets of forming rollers, and thereby form the wire passing through the rollers into a sinusoidal pattern;

(d) drive means coupling together all said driven rollers of said first set so as to rotate said driven rollers at a common surface speed; and (e) means for rotating said feed wire about its own axis while said feed wire is being drawn through said first and second disc-shaped forming roller sets, so as to bend the wire and thereby form it into a helical-shaped structural product.

2. The disc roller forming mechanism of claim 1, wherein said first disc roller set contains at least three fixed position rotatably driven rollers and said second disc roller set contains at least two idler rollers located above the fixed position rollers, the position of the second idler roller set being transversely adjustable relative to the fixed position first roller set in said frame, so as to control the spacing between the two roller sets and thereby control the diameter of the formed helical-shaped product.

3. The disc roller forming mechanism of claim 1, wherein the second roller set of adjustable idler rollers is located substantially horizontally adjacent to the first set of fixed position driven rollers, said idler roller set being transversely adjustable relative to the first set of driven rollers.

4. The disc roller forming mechanism of claim 1, wherein said second roller set is rotatably driven from the rotatable shaft of said first roller set.

5. The disc roller forming mechanism of claim 1, wherein said first driven roller set and said second idler roller set each have substantially equal outside diameters.

6. The disc roller forming mechanism of claim 1, wherein a guide means is provided attached to said frame for guiding the feed wire to the first forming roller set.

7. The disc roller forming mechanism of claim 2, wherein the driven first set of rollers have roughened outer surfaces to provide increased friction between the rollers and the feed wire for drawing the feed wire through the sets of rollers.

8. The disc roller forming mechanism of claim 2, wherein the transverse spacing between said first and second roller sets is progressively decreased for the subsequent disc rollers.

9. The disc roller forming mechanism of claim 1, wherein for a straight feed wire said means for rotation of the wire is a helical-shaped die rigidly attached to the wire being formed, which die initially pulls the wire through the sets of fixed position driven rollers and adjustable idler rollers.

10. The disc roller forming mechanism of claim 1, including a supply spool unit for the feed wire, wherein the feed wire is unrolled from the supply spool rotatable about the axis of the spool, the supply spool unit being simultaneously rotatable about the longitudinal axis of the feed wire.

11. The disc roller forming mechanism of claim 10, wherein the feed wire is pulled off the rotatable supply spool by a pair of driven gripping rollers located between the supply spool and the forming rollers.

12. The disc roller forming mechanism of claim 1, wherein said drive means comprises means for driving both said first and second sets of disc-shaped forming rollers.

13. A disc roller mechanism for forming elongated helical-shaped structures using multiple disc-shaped forming rollers, comprising:

(a) a support frame having a fixed lower member and an adjustable upper member, each said member being adapted for rotatably supporting a shaft, each shaft carrying multiple disc-shaped forming rollers;

(b) a first set of disc-shaped forming rollers including at least three disc-shaped rollers spaced apart from each other and rotatably mounted in said support frame fixed member; said first set of rollers being rotatably driven;

(c) a second set of disc-shaped forming rollers rotatably mounted in said support frame adjustable member, and arranged in a staggered pattern relative to the rollers of said first set, and comprising at least two idler disc-shaped rollers spaced apart from each other and mounted in said adjustable upper frame member, said second disc roller set being substantially, parallel with and transversely adjustable relative to the first set, the axes of said forming rollers in said first and second sets being oriented parallel to the centerline of a feed wire for drawing said wire through said first and second sets of disc-shaped forming rollers solely by a frictional drawing force exerted on the wire by said sets of forming rollers, and thereby form the wire passing through the rollers into a sinusoidal pattern;

(d) drive means coupling together all said driven rollers of said first set so as to rotate said driven rollers at a common surface speed; and (e) means for rotating the feed wire about its own axis while the lead wire is being drawn through said first and second disc-shaped forming rollers, so as to bend the wire and thereby form a helical-shaped structural product.

14. The disc roller forming mechanism of claim 13, wherein said drive means comprises means for driving both said first and second sets of disc-shaped forming rollers.

* * * * *